US009166295B2

(12) United States Patent
Petros

(10) Patent No.: US 9,166,295 B2
(45) Date of Patent: Oct. 20, 2015

(54) ANTENNA

(71) Applicants: Think Wireless, Inc., Coconut Creek, FL (US); Argy Petros, Coconut Creek, FL (US)

(72) Inventor: Argy Petros, Coconut Creek, FL (US)

(73) Assignees: Argy Petros, Coconut Creek, FL (US); Think Wireless, Inc., Coconut Creek, FL (US)

( * ) Notice: Subject to any disclaimer, the term of this patent is extended or adjusted under 35 U.S.C. 154(b) by 141 days.

(21) Appl. No.: 13/742,440

(22) Filed: Jan. 16, 2013

(65) Prior Publication Data

US 2013/0181878 A1 Jul. 18, 2013

Related U.S. Application Data

(60) Provisional application No. 61/587,415, filed on Jan. 17, 2012.

(51) Int. Cl.
*H01Q 9/06* (2006.01)
*H01Q 9/28* (2006.01)

(52) U.S. Cl.
CPC ..... *H01Q 9/065* (2013.01); *H01Q 9/285* (2013.01)

(58) Field of Classification Search
USPC ..... 343/795, 807, 810, 815, 817–819, 809, 343/820, 822
See application file for complete search history.

(56) References Cited

U.S. PATENT DOCUMENTS 5,027,128 A 6/1991 Blaese
5,448,256 A * 9/1995 Ohashi et al. ..... 343/878
5,541,611 A 7/1996 Peng et al.
6,008,773 A 12/1999 Matsuoka et al.
D424,063 S 5/2000 Kudo
D434,752 S 12/2000 Kudo
6,326,932 B1 12/2001 Mannan
6,421,018 B1 7/2002 Zeilinger et al.
6,424,309 B1 7/2002 Johnston et al.
6,762,729 B2 7/2004 Egashira
7,019,704 B2 3/2006 Weiss
7,123,207 B2 10/2006 Yazdandoost et al.
7,202,827 B2 4/2007 Donald
7,372,417 B2 5/2008 Fukuchi
7,486,249 B2 2/2009 Fujita et al.
D587,693 S 3/2009 Ohshima
7,498,993 B1 * 3/2009 Lee et al. ..... 343/713
D604,275 S 11/2009 Norris et al.
7,612,733 B2 11/2009 Weiss et al.
2004/0174309 A1 * 9/2004 Terreault et al. ..... 343/703
2007/0046465 A1 * 3/2007 Sakama et al. ..... 340/572.1
2009/0066600 A1 * 3/2009 Rabinovich ..... 343/793
2009/0207088 A1 8/2009 Sato
2010/0220022 A1 9/2010 Yoon et al.
2010/0321271 A1 12/2010 Keate et al.
2011/0037656 A1 2/2011 Bremmer et al.

* cited by examiner

*Primary Examiner* — Dieu H Duong
(74) *Attorney, Agent, or Firm* — Sand & Sebolt

(57) ABSTRACT

A bowtie antenna is presented. The antenna includes a substrate with a metal layer. The bowtie-shaped dipole antenna is formed in the metal layer with two triangle elements and a gap between the two triangle elements. The bowtie-shaped antenna is shaped to receive signals in a lower portion of the UHF band. A pair of transmission lines is formed in the metal extending from the gap. At least one pair of tuning stubs is formed in the metal. The pair of tuning stubs extends from the transmission lines and is tuned to a frequency band that is different than the lower portion of the UHF band.

14 Claims, 5 Drawing Sheets

ANTENNA

CROSS REFERENCE TO RELATED APPLICATION

This application claims priority from U.S. Provisional Application Ser. No. 61\587,415, filed Jan. 17, 2012; the disclosure of which is incorporated herein by reference.

BACKGROUND OF THE INVENTION

1. Field of Invention

The current invention relates generally to apparatus, systems and methods for receiving wireless data. More particularly, the apparatus, systems and methods relate to receiving VHF and UHF signals. Specifically, the apparatus, systems and methods provide for receiving video data with a planar bowtie-shaped dipole antenna.

2. Description of Related Art

There are numerous types and installation options of television (TV) antennas today. Outdoor TV antennas, once designed and installed properly, can provide good reception. However, high cost, large size, and installation difficulties do not make them an attractive solution.

Indoor TV antennas are more popular than outdoor antennas due to low cost and ease of installation. However, their performance is significantly less than that of the outdoor antennas. Indoor antennas are often placed near televisions and furniture and reception is affected due to signal blockage from metallic and non-metallic objects nearby and interfering electronic equipment or appliances. In addition, indoor antennas, due to their compact size, are not well-matched along the required frequency bandwidth.

Some indoor TV antennas can be mounted on a wall. In this case, the performance may be affected due to the proximity of metal behind the antenna and due to the blockage of nearby objects. One of the best locations to mount a TV antenna is at a window. A window location is often as close to an outside location as possible without installing the antenna outside, therefore, the performance of the antenna is often very good when installed at a window.

Recently, miniature analog and digital TV receivers have been developed. For example, TV sticks that plug into a computer's USB port are portable low profile antennas that are often not very efficient. This is because manufacturers of these miniature TV receivers use small stick type antennas that have very poor efficiency which results in a poor reception.

There is an additional need for a low-profile efficient antenna for mobile applications. A flat window-mount TV antenna can be used in mobile applications such as car, vans, trucks, boats, etc. However, most current indoor TV antennas are not designed for use in mobile applications. They are bulky and are not easily installed in a vehicle.

Current compact antennas include indoor antennas such as dipole type ("rabbit ears") and other antennas mounted on a wall or on top of existing antennas and furniture. These types of antennas are naturally low-gain antennas and they are generally ineffective for fringe areas. In the case of rabbit ears, in order to receive a low-frequency signal, the dipoles must be extended to their maximum length. This may result in a poor reception of high-frequency signals. In addition, the antenna no longer looks aesthetically pleasing. Other available types of compact antennas are generally not well-matched due to their small size. Therefore, there exists a need for a better TV antenna.

SUMMARY OF THE INVENTION

The preferred embodiment of the invention is an antenna implemented using printed-circuit technology. The antenna is a combination of a planar bowtie-shaped dipole, a parasitic element and one or more tuning stubs. The antenna can be formed of a low-cost substrate such as FR-4, MYLAR, Kapton or any other similar material.

In a preferred embodiment, the bowtie antenna is printed on a single metal surface of the substrate. A parasitic section on top of the antenna helps improve the impedance. The two elements of the bowtie antenna are connected to a parallel transmission line. In addition, there are two sets of tuning stubs, one set optimized is in the VHF band and the other set is optimized in the upper UHF band and both sets are connected to the parallel transmission line. A coaxial cable is also connected to the parallel transmission line. This arrangement results in an efficient antenna system in the VHF and UHF bands.

In a second embodiment of the invention, the bowtie antenna is connected to retractable metallic elements for low-frequency tuning. These elements extend the frequency of operation to the VHF band without affecting the reception performance in the UHF frequency band.

The small cross-section of the antenna of the present invention makes it suitable for window mounting and wall hanging. The antenna of the present invention incorporates a pair of suction cups for window mounting and a pair of holes for wall hanging.

A third embodiment of the invention includes a very high frequency (VHF) and/or ultra high frequency (UHF) antenna. The VHF and/or UHV antenna includes a substrate with a metal layer. A bowtie-shaped dipole antenna is formed in the metal layer with two triangle elements with a gap between the two triangle elements. The triangle elements can be isosceles triangles. The bowtie-shaped antenna is shaped to receive signals in a lower portion of the UHF band. A pair of transmission lines is formed in the metal layer extending from the gap. At least one pair of tuning stubs is formed in the metal layer. The pair of tuning stubs extends from the transmission lines and is tuned to a frequency band that is different than the lower portion of the UHF band.

In some configurations, the triangle elements are isosceles triangles with a first side and a second side that are equal in length. Isosceles triangle points are formed where the first sides and the second sides meet. The isosceles triangle points lay on a centerline adjacent each other but are separated from each other by a gap. Third sides of the isosceles triangles that are not equal to any other isosceles triangles sides lie on the centerline remote from and non-adjacent each other so that the centerline bisects the third sides. In some configurations, a perpendicular line passes through the gap perpendicular to the centerline and the antenna is symmetrical about the perpendicular line.

In other configurations, a parasitic element is formed in the metal on an upper side of the substrate. The parasitic element is formed between the gap and the upper side. The parasitic element is also formed between the isosceles triangles and the upper side. The parasitic element can be formed with at least three sides with two sides being parallel to the equal length sides of each of the isosceles triangles. The transmission lines can be parallel transmission lines that are generally rectangular in shape extending from the isosceles triangle points.

The tuning stubs can include upper UHF tuning stubs that are generally elongated and rectangular in shape with short sides and long sides. The short sides can be parallel to the perpendicular line and the longs sides are generally parallel to the centerline. The tuning stubs can also include a pair of VHF tuning stubs located at least partially between the upper UHF tuning stubs and the triangle elements. Each of the VHF tuning stubs can include first elongated sections, jog sections and elongated end sections. Each of the VHF tuning stubs can form a meandering line. The first elongated sections extend from the transmission lines and run between the upper UHF tuning stubs and the triangle elements and are generally parallel to the upper UHF tuning stubs. The elongated end sections point in a direction generally parallel to an elongated direction of the upper UHF tuning stubs. The jog sections are positioned between the first elongated section and the elongated end sections to jog the VHF tuning stubs around ends of the upper UHF tuning stubs. The VHF tuning stubs operate, at least in part, in a 30 MHz to 300 MHz band, the triangle elements operate, at least in part, in a 300 to 700 MHz band, and the upper UHF tuning stubs operate, at least in part, in a 700 MHz to 1 GHz band.

Another configuration of the preferred embodiment comprises a substrate having a metal layer. The metal layer is formed with a bowtie-shaped dipole antenna, a pair of transmission lines and one or more tuning stubs. The bowtie-shaped dipole antenna is formed with two triangle elements with a gap between the two triangle elements at the center of the bowtie. The bowtie-shaped antenna is tuned to a first frequency band. The pair of transmission lines extend from near the gap and one or more tuning stub pairs extend from the transmission lines and are tuned to a second frequency band that is different than the first frequency band.

BRIEF DESCRIPTION OF SEVERAL VIEWS OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
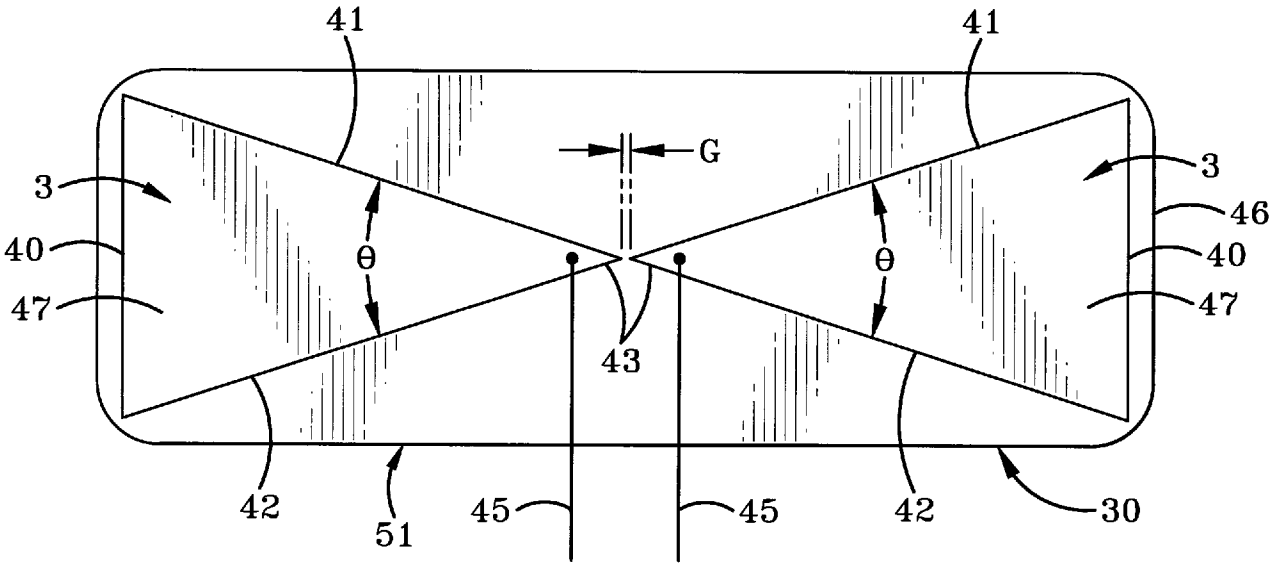
FIG. 1 illustrates a preferred embodiment of a bowtie-shaped dipole antenna for use with the UHF band.

FIG. 1 illustrates the preferred embodiment of an improved bowtie antenna 1. The bowtie antenna 1 is primarily configured to receive HDTV signals; however, the antenna 1 can be used with other electronic devices. One of the major components of the bowtie antenna 1 is a substrate 30 that includes a base layer 46 and a metal layer 47. The metal layer 47 is formed with a bowtie-shaped antenna with two triangle-shaped elements 3. The triangle-shaped elements 3 form a pair of dipole antennas that operate in the lower UHF frequency band in the range of about 300 to 700 MHz. Before describing further details of the bowtie antenna 1, some of its benefits and useful features are described. The bowtie antenna of FIG. 1 has improved reception performance for an indoor antenna, a compact and slim form, is low-cost and easily hidden without its performance being degraded, and can function as a low profile antenna for mobile applications. Additionally, it has good reception capability, flexible installation options, is aesthetically pleasing, and can be easily hidden.

In the preferred embodiment, each triangle-shaped element 3 is generally triangular in shape. Each triangle is formed by outer sides 40, upper tapered sides 41 and lower tapered sides 42. These sides are illustrated in FIG. 1 as being the same between each of the two triangle-shaped elements 3. However, one or more of these sides could be different between the two triangle-shaped elements 3. The upper tapered sides 41 and the lower tapered sides 42 extend from ends of the outer sides 40 and form central end points 43 where the upper tapered sides 41 and the lower tapered sides 42 touch each other generally near the center of the substrate 30.

In the preferred embodiment, the upper tapered sides 41 and the lower tapered sides 42 are equal in length so that they form an isosceles triangle with the outer sides 40. The length of the outer sides 40 is about 7.5 centimeters and the length of the upper tapered sides 41 and the lower tapered sides 42 is about 14.5 centimeters; however, these sides could be other lengths. In the preferred embodiment, the angle θ between the upper tapered sides 41 and the lower tapered sides 42 is generally in the range of between 5 to 30 degrees, however, other ranges of θ could be used. The two triangle-shaped elements 3 are formed so that there is a small gap "G" between the two central end points 43 of about 2 millimeters but other gap G distances could be used.

A pair of output lines 45 can be attached near the central end points 43. For example, two conductors of a cable can be connected (e.g., soldered) to the central end points 43. Signals received by the antenna 1 can be received from the output lines 45 and processed by a TV or another electronic device associated with the antenna 1.

Figure 2:
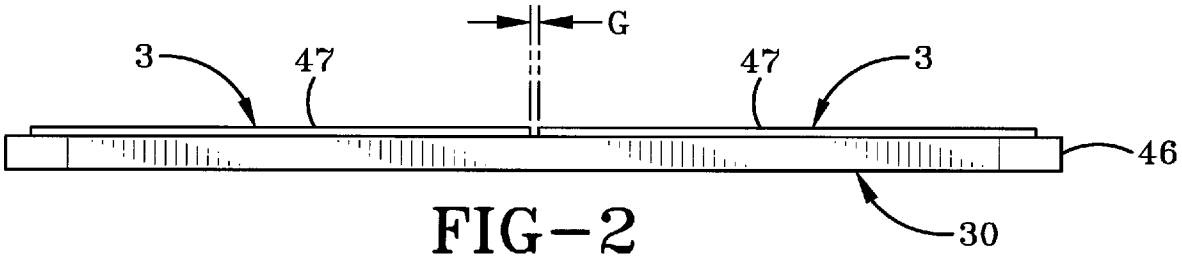
FIG. 2 illustrates a cross-sectional view of a substrate and metal used to build the preferred embodiment of the bowtie-shaped dipole antenna for use with the UHF band.
Figure 3A:
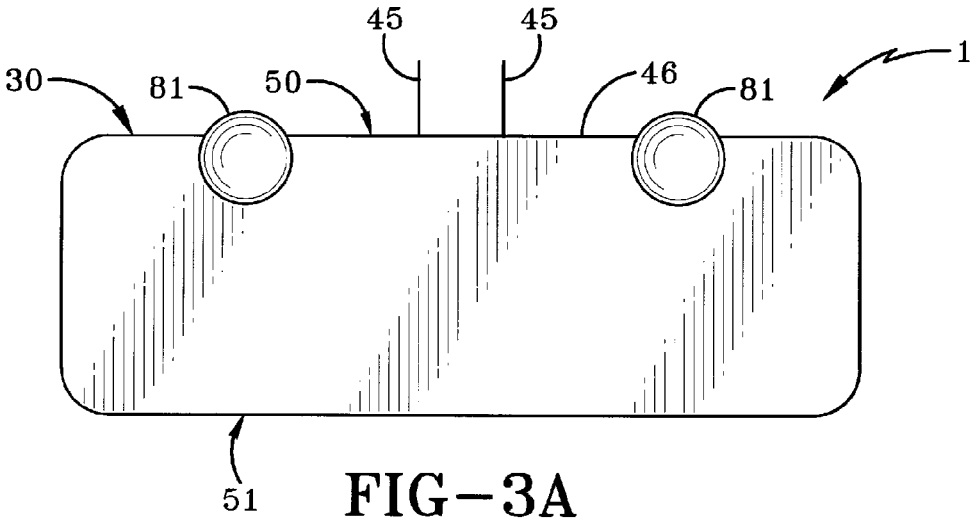
FIGS. 3A and 3B illustrate a second embodiment of a preferred embodiment of a bowtie-shaped dipole antenna for use with VHF and UHF bands.
Figure 3B:
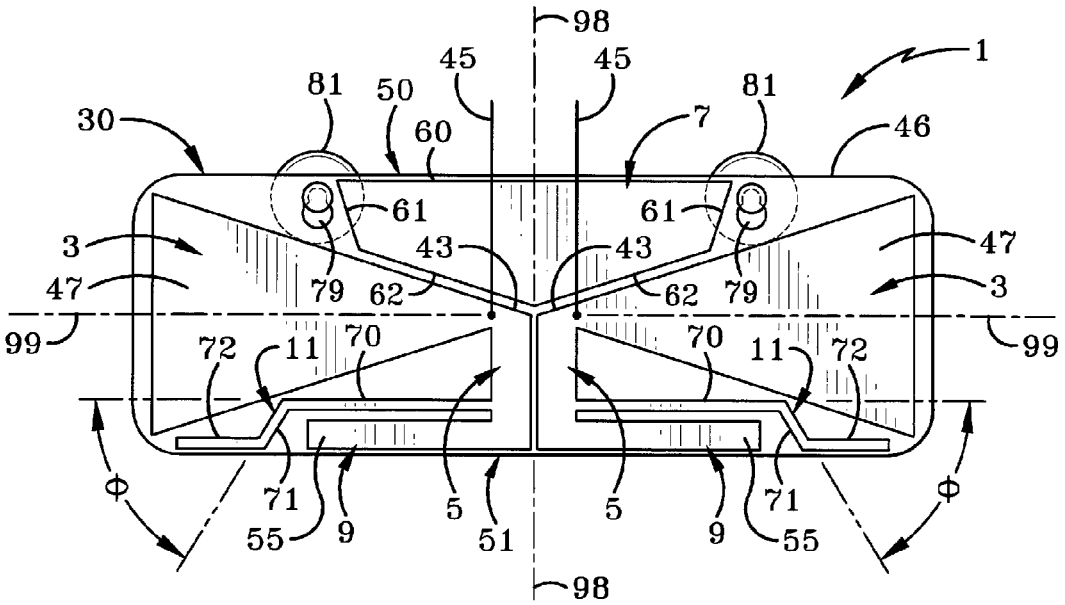

As illustrated in FIG. 2, the substrate 30 includes a base layer 46 and a metal layer 47. In the preferred embodiment, the substrate 30 is a low-cost substrate such as FR-4, MYLAR, Kapton or any other similar material as understood by those of ordinary skill in the art. The two triangle-shaped elements 3 are formed in the metal 47 on the upper surface of the substrate 30. In the preferred embodiment, the metal is copper; however, other metals can be used In another configuration of the preferred embodiment as illustrated in FIG. 3, the antenna 1 includes a parasitic section 7 formed in the metal layer 47 located in the "upper" portion 50 of the antenna 1. The parasitic section 7 has a top side 60, two tapered sides 61 and two tapered bottom sides 62. The parasitic section 7 helps improve the overall impedance of the antenna 1. Similar to the preferred embodiment of FIG. 1, this embodiment can include a pair of output lines 45 attached near the central end points 43.

This configuration of the preferred embodiment can also include one or more pairs of tuning stubs 9, 11 formed in the metal layer 47 on the substrate 30 as also shown in FIG. 3. The tuning stubs 9, 11 extend generally parallel to the triangle-shaped elements 3 and outwardly from a pair of transmission lines 5. Even with the tuning stubs 9, 11 and transmission lines, the antenna 1 is symmetrical about a perpendicular line 98 passing through the antenna. For example, the metal layer 47 of the substrate 30 can be formed with upper UHF tuning stubs 9 that can operate 700 MHz to 3 GHz band of frequencies and/or a pair of VHF tuning stubs 11 that can operate in the 30 to 300 MHz VHF band of frequencies. Of course, the tuning stubs 9, 11 can operate in different portions of these frequencies or in other frequency bands. Tuning stubs 9, 11 are illustrated as being located near the bottom end 51 of the antenna; however, the stubs 9, 11 could be located in other locations as understood by those of ordinary skill in the art.

In this configuration of this embodiment, the upper UHF tuning stubs 9 are generally rectangular in shape with the long side generally parallel to the triangle-shaped elements 3. The length of these tuning stubs 9 is about 10 times longer than their width. For example, the upper UHF tuning stubs 9 can be about 3.5 centimeters long and about 7 millimeters wide. However, the dimensions and shape of the upper UHF tuning stubs 9 could be other shapes and/or other dimensions.

In this configuration of this embodiment, the VHF stubs 11 are each formed with elongated segments of metal 47 formed on the substrate 30. A pair of first segments 70 each extend from the transmission lines 5 and run generally parallel to a centerline 99 of the pair of bowtie-shaped antenna elements 3 and the upper UHF tuning stubs 9. Each of the pair of first segments 70 can be about 7.5 centimeters long and about 2 millimeters wide, however, other shapes and dimensions could be used. A pair of second segments 71 of the VHF stubs 11 extend from the first segments 70 at an angle $\phi$ in order to bend the VHF stubs 11 around the ends 55 of the UHF tuning stubs 9. The angle $\phi$ is illustrated at about 55 degrees and the length of the pair of second segments 71 is about 1.5 centimeters and their width is about 2 millimeters, however, other angles, shapes and dimensions could be used. A pair of third segments 72 extend from the pair of second segments 71 and similar to the first pair of segments 70, run generally parallel to the pair of bowtie-shaped antenna elements 3 and parallel to the upper UHF tuning stubs 9. The pair of third segments 72 each has a length of about 4.5 centimeters and a width of about 2 millimeters; however, other shapes and dimensions could be used.

Figure 4:
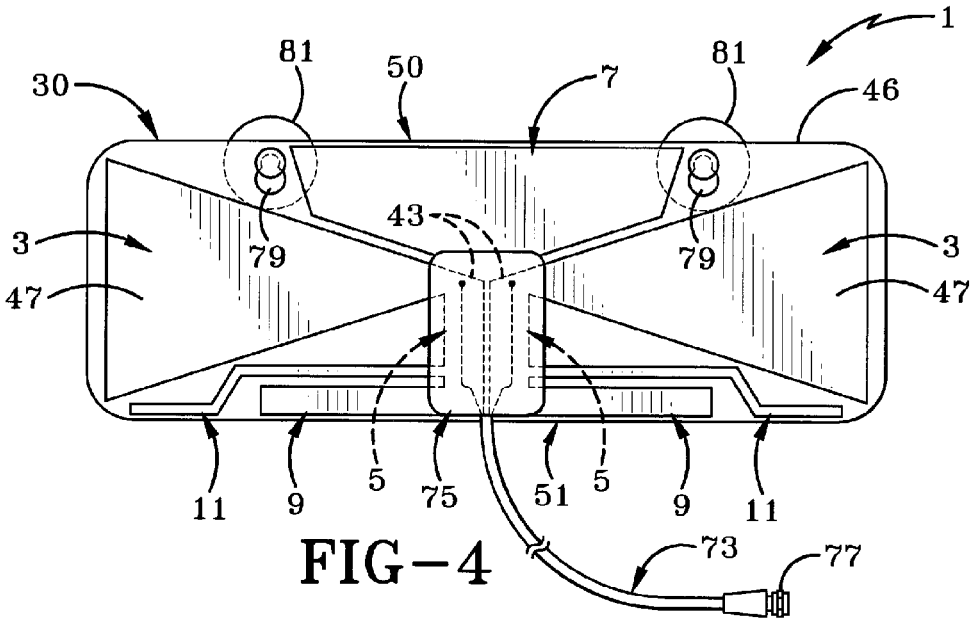
FIG. 4 illustrates additional details of the second embodiment of a preferred embodiment of the bowtie-shaped dipole antenna for use with VHF and UHF frequencies.

Each of two conductors of a coaxial cable 73 (FIG. 4) or other suitable cable can be connected to each of the central end points 43 so that a signal received by the antenna 1 can be transferred over the cable to a TV or other electronic device associated with the antenna 1. As shown in FIG. 4, a small housing 75 can be used to cover the attachment point of a cable 73 to the antenna as well as to the parallel transmission lines 5. The housing 75 can be a rectangular-shaped box with an open side that mounts onto the substrate surface. The housing 75 can be attached to the substrate 30 in any suitable way, for example, with one or more screws. A suitable connector 77 can be attached at the remote end of the cable 73. In other configurations, the housing 75 can cover more, less or all of the antenna 1 rather than just the portion illustrated in FIG. 4.

Figure 5:
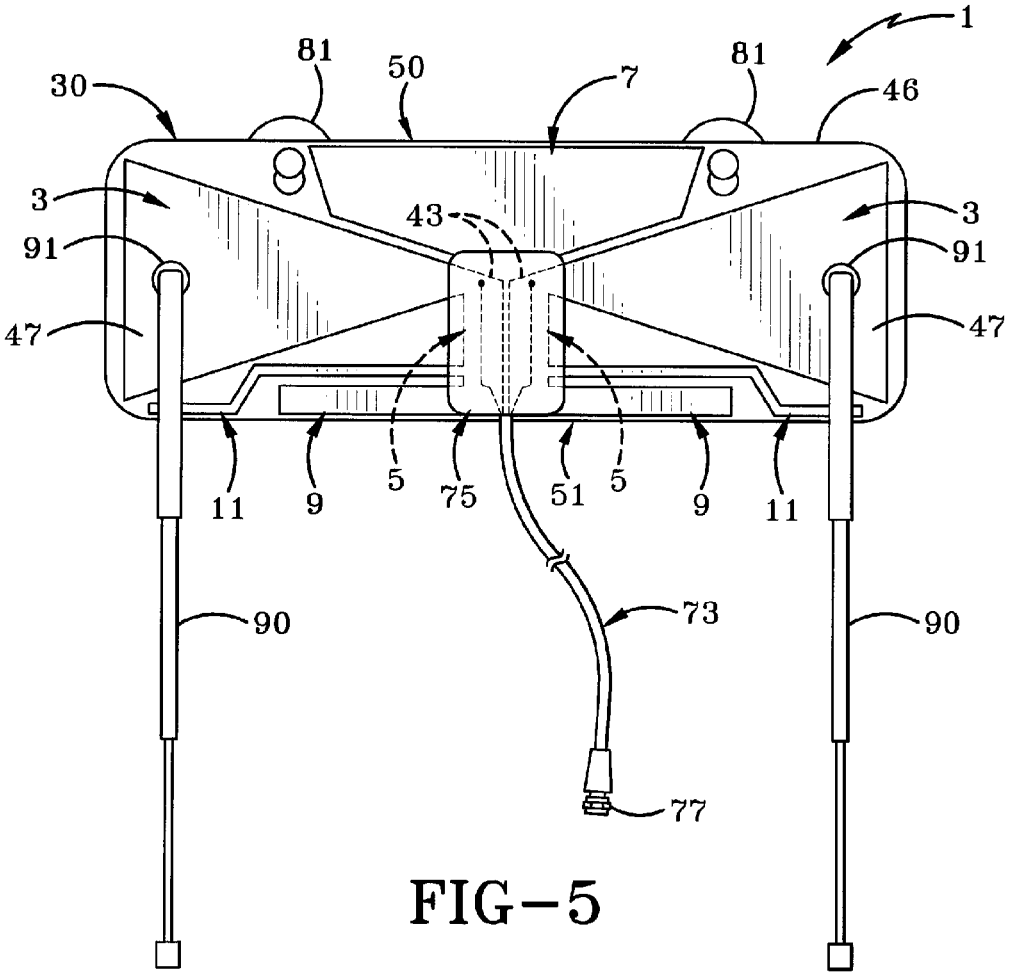
FIG. 5 illustrates a third embodiment of a bowtie-shaped dipole antenna for use with VHF and UHF bands that includes telescoping antennas.
Figures 6, 7:
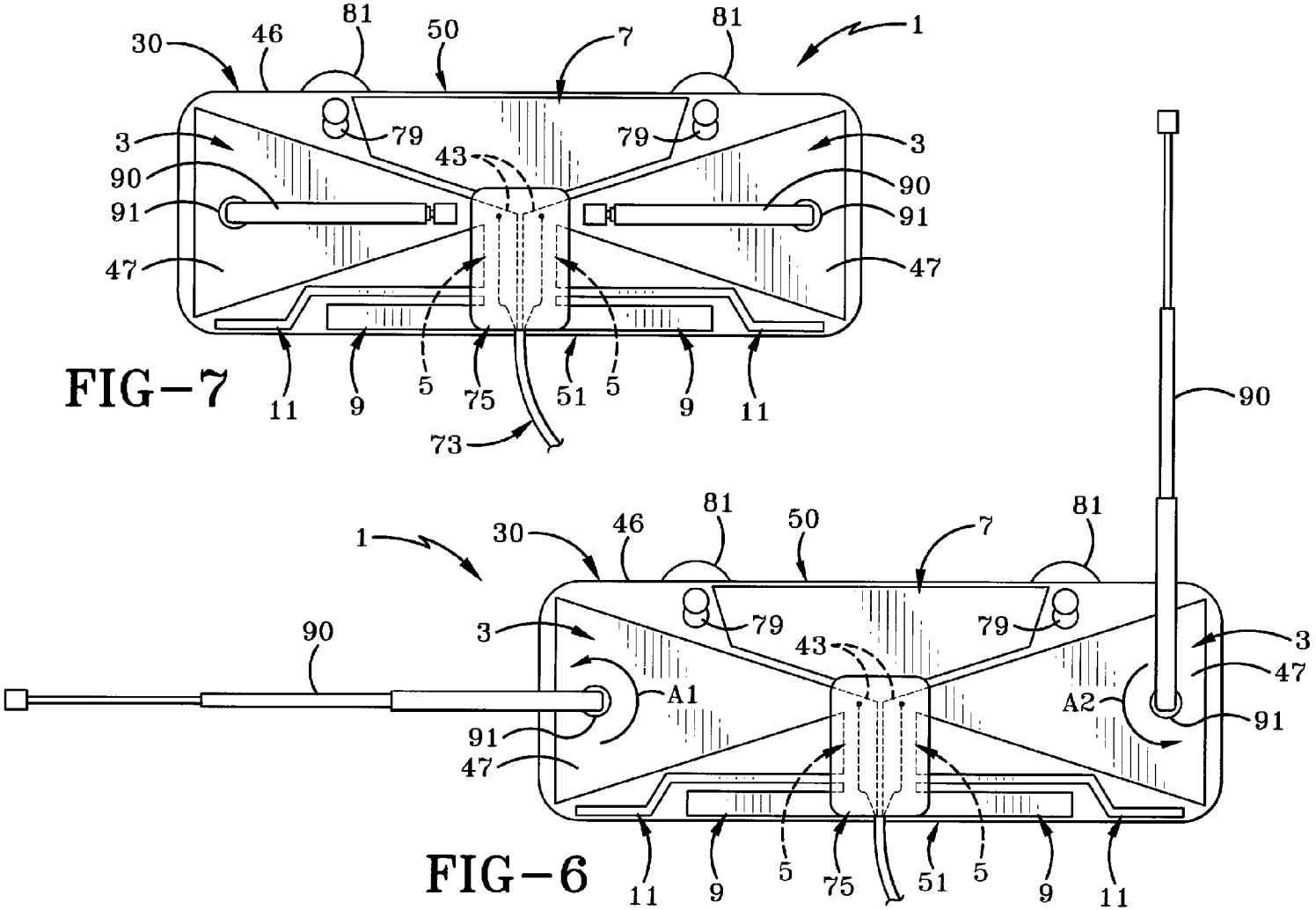
FIG. 6 illustrates movement of the telescoping antennas of the third embodiment of the bowtie-shaped dipole antenna.
FIG. 7 illustrates the third embodiment of the bowtie-shaped dipole antenna for use with VHF and UHF bands with the telescoping antennas in a retracted stored position.

FIGS. 5-7 illustrate the antenna 1 with a pair of telescoping antennas 90 attached to the bowtie-shaped antenna elements 3. These antennas 90 provide for low-frequency tuning to extend the operation of the antenna 1 to the VHF band without significantly effecting performance in the UHF band. They can be attached with a universal type of connector 91 so that they can be rotated and positioned (as shown by arrows A1 and A2 in FIG. 6) for maximum signal reception. For example, the connectors 91 allow each telescoping antenna to be rotated clockwise as shown by arrow A2 and rotated counter clockwise as shown by arrow A1. The connectors 91 also allow the telescoping antennas 90 to each be elevated at different angles from the substrate 30. FIG. 5 illustrates the telescoping antennas 90 telescoped (e.g., extended) outward and FIG. 7 illustrates the telescoping antennas 90 in a retracted position and folded alongside the bowtie-shaped antenna elements 3.

The antenna 1 can contain other useful components and features. For example, holes 79 can be formed in the antenna 1 and suction cups 81 or other mounting device can be used in combination with the holes 79 to hang or mount the antenna 1. In some configurations, one of both sides of the antenna 1 can be painted, silk screened, or provided a finished coating of any color so that the antenna 1 would appear attractive to a user of the antenna 1.

Figure 8:
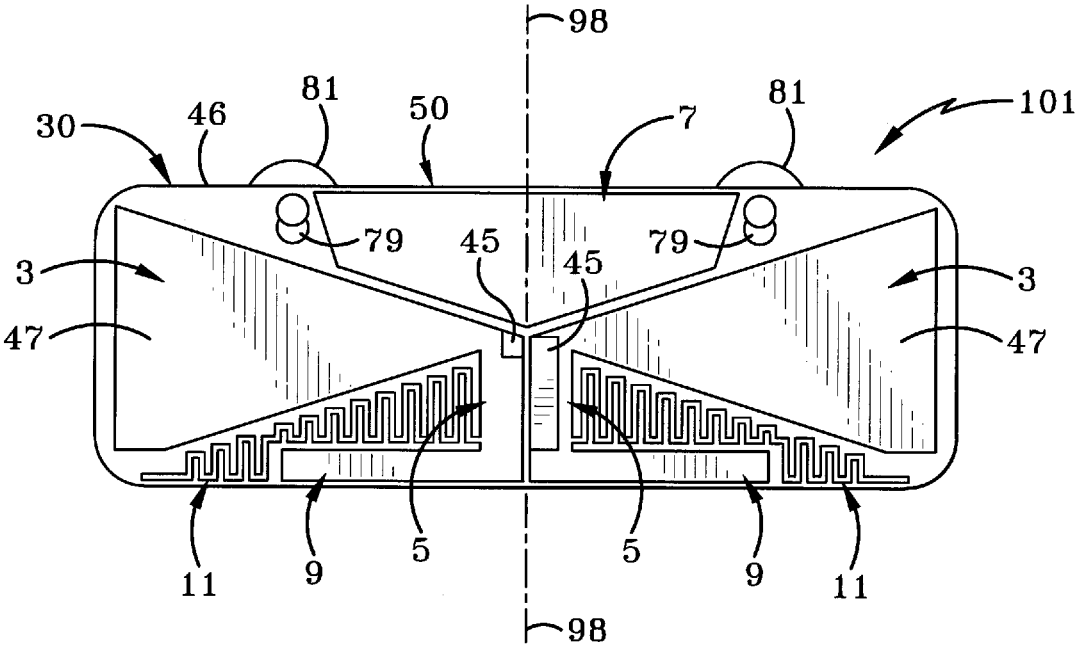
FIG. 8 illustrates another embodiment with a VHF antenna comprised of several short segments connected together in a meandering type of pattern.

Another configuration of the preferred embodiment is illustrated in FIG. 8. This antenna 101 is similar to Antenna 1 of FIG. 3 except that antenna 101 includes a pair of meandering antenna stubs 111. These stubs 111 can be tuned to the VHF range and can be described as laid out in "ziz-zag" pattern with the shape of a series of increasing and/or decreasing rectangular patterns. In FIG. 8, about 11 "pulses" of rectangular patterns are shown but any number of these rectangle shaped "pulses" can be used. Of course, other meandering shapes can be used to create the meandering antenna stubs 111 than what is shown in FIG. 8.

This antenna 101 includes triangle shaped antenna elements 3, transmission lines 5, a parasitic section 7 and upper VHF stubs 9 similar to the embodiment shown in FIG. 3. These components can be very similar to those of FIG. 3 or they can be shaped differently. Electrical signals can be received into output lines 45 and provided to an HDTV or other electrical device attached to the antenna 111. As discussed above, a coaxial cable can be attached to the triangle-shaped antenna elements 3 in place of the output lines. Even with the tuning stubs 9, 111 and transmission lines 5, the antenna 101 can be symmetrical about a perpendicular line 98 passing through the antenna.

In other configurations, the antenna 1 of FIG. 1 and the other embodiment described above can be configured as a dual-mode antenna. The dual mode antenna can operate as a passive antenna or as an active antenna that includes an amplifier to amplify signals on the antenna and/or generated by the antenna. For example, an amplifier could be located on the same substrate 30 as the bowtie antenna elements. The dual mode antenna allows it to be passive (when there is no power) or active (if you connect power to it using a power injector and AC adapter). The use of a mechanical switch (or relay) or other switching device as understood by those of ordinary skill in the art provides for the ability to switch between the two modes. For example, when there is no power, the relay is not active and the cable center conductor is connected to just the antenna. When power is applied, the relay kicks in and the switch moves to the amplifier output. So, now the cable center conductor is connected to the amplifier output.

Having described the components of the preferred embodiment of an antenna 1 and other embodiments and configurations of a bowtie antenna, their use and operation are now discussed. Initially, the antenna 1 can be mounted on a flat surface, preferably on an exterior window using suction cups 81. A connector of the coaxial cable 73 can then be attached to an HDTV or other electronic device. Generally the antenna 1 will operate in the lower UHF band through the bowtie antenna elements 5. Antenna signals are received by the antenna 1 and passed to the HDTV or other electronic device attached to the antenna 1 through the coaxial cable 73. The antenna 1 can also operate in the lower UHF band through tuning stubs 9 or in the VHF band through tuning stubs 11. The HDTV or another electronic device can also be tuned to the VHF band by moving and positioning the telescoping antennas 90 when low-frequency tuning is needed to extend the operation of the antenna 1 to the VHF band without significantly effecting performance in the UHF band.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. An antenna comprising:

a substrate with a metal layer;

a bowtie-shaped dipole antenna formed in the metal layer with two triangle elements with a gap between the two triangle elements, and wherein the bowtie-shaped dipole antenna is tuned to a lower portion of the UHF band;

a pair of transmission lines formed in the metal extending from near the gap; and at least one pair of tuning stubs formed in the metal and extending from the transmission lines, wherein each of the at least one pair of tuning stubs is tuned to a frequency band that is different than the lower portion of the UHF band;

wherein the triangle elements are generally isosceles triangles;

wherein a first side and a second side are equal length sides of the isosceles triangles, wherein isosceles triangle points are formed where first sides and the seconds side touch, wherein the isosceles triangle points lie on a centerline adjacent each other but separated from each other by the gap, wherein third sides of the isosceles triangles that are not equal to any other isosceles triangles sides cross the centerline remote from and non-adjacent each other so that the centerline bisects the third sides;

wherein a perpendicular line passes through the gap perpendicular to the centerline, wherein the at least one pair of tuning stubs includes a pair of upper UHF tuning stubs that are generally elongated and rectangular in shape with short segments and long segments, wherein the short segments are generally parallel to the perpendicular line and the long segments are generally parallel to the centerline;

wherein the at least one pair of tuning stubs includes a pair of VHF tuning stubs at least partially between the upper UHF tuning stubs and the triangle elements; and wherein each of the pair of VHF tuning stubs further comprises:

first elongated sections extending from the transmission lines, between the upper UHF tuning stubs and the triangle elements, and generally parallel to the upper UHF tuning stubs;

jog sections; and elongated end sections pointing in a direction generally parallel to an elongated direction of the upper UHF tuning stubs, wherein the jog sections are positioned between the first elongated sections and the elongated end sections to jog the VHF tuning stubs around ends of the upper UHF tuning stubs.

2. The antenna of claim 1 wherein a perpendicular line passes through the gap perpendicular to the centerline and wherein the bowtie-shaped dipole antenna is symmetrical about the perpendicular line.

3. The antenna of claim 1 wherein an upper side of the metal layer is on one side of the centerline and a bottom side of the metal layer is on the opposite side to the centerline, and further comprising:

a parasitic element formed in the metal on the upper side of the substrate, wherein the parasitic element is formed between the gap and the upper side, and wherein the parasitic element is formed between the isosceles triangles and the upper side.

4. The antenna of claim 3 wherein the parasitic element is formed with at least three sides including a parasitic first side and a parasitic second side, wherein the isosceles triangles include a first isosceles triangle and a second isosceles triangle, wherein the first parasitic side runs parallel to one of the sides of the first isosceles triangle and wherein the second parasitic side runs parallel to one of the sides of the second isosceles triangle.

5. The antenna of claim 1 wherein the VHF tuning stubs operate, at least in part, in a 30 to 300 MHz frequency band, wherein the triangle elements operate, at least in part, in a 300 to 700 frequency MHz band and wherein the upper UHF tuning stubs operate, at least in part, in an 800 MHz to 1 GHz frequency band.

6. The antenna of claim 1 wherein the antenna, VHF tuning stubs, UHF tuning stubs and transmission lines are symmetrical about the perpendicular line.

7. The antenna of claim 1 further comprising:

telescoping antennas attached to the triangle elements adapted to improve low frequency tuning.

8. The antenna of claim 1 further comprising:

at least one hanging device for hanging the bowtie-shaped dipole antenna from a vertical surface.

9. The antenna of claim 8, wherein the hanging device is a suction cup adapted to attach to a flat surface.

10. The antenna of claim 1 wherein the pair of transmission lines are parallel transmission lines.

11. The antenna of claim 10 wherein the transmission lines generally extend from the isosceles triangle points, and wherein the parallel transmission lines are generally rectangular in shape.

12. The antenna of claim 1 wherein the metal is copper.

13. The antenna of claim 1 wherein the antenna is symmetric about the perpendicular line.

14. The antenna of claim 13 wherein the centerline divides the antenna into a top section and a bottom section of the antenna, and wherein the at least one pair of tuning stubs is in the bottom section and further comprising:

a parasitic section formed with at least three sides in the metal layer in the upper section of the antenna, wherein at least two sides of the parasitic section extend parallel to one of the two equal length sides of each of the two isosceles shaped triangles.

* * * * *